US008499552B2

(12) United States Patent
Kauss et al.

(10) Patent No.: US 8,499,552 B2
(45) Date of Patent: Aug. 6, 2013

(54) METHOD AND HYDRAULIC CONTROL SYSTEM FOR SUPPLYING PRESSURE MEDIUM TO AT LEAST ONE HYDRAULIC CONSUMER

(75) Inventors: Wolfgang Kauss, Francheville (FR); Matthieu Desbois-Renaudin, Villardde Lans (FR)

(73) Assignee: Robert Bosch GmbH, Stuttgart (DE)

( * ) Notice: Subject to any disclaimer, the term of this patent is extended or adjusted under 35 U.S.C. 154(b) by 871 days.

(21) Appl. No.: 12/665,593

(22) PCT Filed: Jun. 20, 2008

(86) PCT No.: PCT/EP2008/004990

§ 371 (c)(1),
(2), (4) Date: Dec. 18, 2009

(87) PCT Pub. No.: WO2009/000472

PCT Pub. Date: Dec. 31, 2008

(65) Prior Publication Data

US 2010/0186401 A1 Jul. 29, 2010

(30) Foreign Application Priority Data

Jun. 26, 2007 (DE) ..... 10 2007 029 358

(51) Int. Cl.
*F15B 11/024* (2006.01)
*F15B 21/14* (2006.01)

(52) U.S. Cl.
USPC ..... 60/327; 60/461; 91/436

(58) Field of Classification Search
USPC ..... 91/436; 60/422, 499, 449, 327, 60/461, 459
See application file for complete search history.

(56) References Cited

U.S. PATENT DOCUMENTS 2,946,347 A 7/1960 Ruhl
4,083,382 A 4/1978 Khatti et al.

(Continued)

FOREIGN PATENT DOCUMENTS

CA 2 231 498 5/1997
DE 27 51 946 7/1978

(Continued)

OTHER PUBLICATIONS

"Electro-Proportional Swivel Angle Control." Bosch Rexroth Group. Technical Data Sheet. Re. 92 708/04.05 1/8. Apr. 2005.

(Continued)

*Primary Examiner* — Edward Look
*Assistant Examiner* — Logan Kraft
(74) *Attorney, Agent, or Firm* — Michael J. Striker

(57) ABSTRACT

The invention relates to a hydraulic control arrangement and to a method for controlling a hydraulic consumer that comprises a pressure chamber on the input side and on the return side, said pressure chamber being connected to an adjusting pump or a tank via a valve device. The valve device is controlled by means of a control unit via which it can be adjusted in a regeneration mode, in which both pressure chambers are connected to the adjusting pump. According to the invention, the adjusting pump is pressure controlled, whereby in the regeneration mode, it is automatically switched to the normal operation in which the supply side of the pressure chamber is connected to the adjusting pump and the return side of the pressure chamber is connected to the tank when the pumping rate falls below the demand for the pressure medium.

17 Claims, 7 Drawing Sheets

U.S. PATENT DOCUMENTS

| | | | | |
|---|---|---|---|---|
| 4,184,512 | A | 1/1980 | Pignolet | |
| 4,355,660 | A | 10/1982 | Huffman | |
| 4,745,747 | A | 5/1988 | Krausse et al. | |
| 5,138,838 | A | 8/1992 | Crosser | |
| 5,218,897 | A * | 6/1993 | Shirai et al. | 91/436 |
| 5,273,069 | A | 12/1993 | Akiyama et al. | |
| 5,305,789 | A | 4/1994 | Rivolier | |
| 5,398,507 | A | 3/1995 | Akiyama et al. | |
| 5,806,312 | A | 9/1998 | Kauss | |
| 5,862,831 | A | 1/1999 | Chung | |
| 5,996,623 | A | 12/1999 | Omberg | |
| 6,305,163 | B1 | 10/2001 | Paakkunainen | |
| 6,327,959 | B1 | 12/2001 | Takahashi | |
| 6,334,308 | B1 | 1/2002 | Sato et al. | |
| 6,349,543 | B1 | 2/2002 | Lisniansky | |
| 6,367,365 | B1 | 4/2002 | Weickert et al. | |
| 6,468,046 | B1 * | 10/2002 | Du et al. | 417/222.1 |
| 6,932,113 | B1 | 8/2005 | Kauss | |
| 7,213,501 | B2 | 5/2007 | Kauss et al. | |
| 7,337,807 | B2 | 3/2008 | Koo et al. | |
| 7,634,961 | B2 | 12/2009 | Asakage et al. | |
| 2002/0050295 | A1 | 5/2002 | Fiala et al. | |
| 2003/0106420 | A1 * | 6/2003 | Yoshino | 91/454 |
| 2007/0006580 | A1 * | 1/2007 | Hesse | 60/452 |

FOREIGN PATENT DOCUMENTS

| | | |
|---|---|---|
| DE | 34 22 978 | 1/1986 |
| DE | 37 09 504 | 10/1988 |
| DE | 43 08 004 | 10/1993 |
| DE | 196 08 801 | 9/1997 |
| DE | 198 31 595 | 1/2000 |
| DE | 199 48 232 | 1/2001 |
| DE | 199 49 802 | 4/2001 |
| DE | 199 58 257 | 6/2001 |
| DE | 103 25 294 | 12/2004 |
| DE | 10 2005 928 | 6/2006 |
| EP | 0 566 449 | 10/1993 |
| EP | 1 092 095 | 4/2001 |
| EP | 1 170 510 | 1/2002 |
| EP | 1 691 083 | 8/2006 |
| EP | 1 813 821 | 8/2007 |
| JP | 3-51201 | 5/1991 |
| WO | 90/10795 | 9/1990 |

OTHER PUBLICATIONS

"Counterbalance, Standard Poppet Type Differential Area Special Cavity" VBSO-SEC-42, 04.52.12-X-99-Z. Sep. 2005.

Re. 64 552: "Hydralische Vorsteuergeraet in . . . " Bosch Rexroth AG, May 2006, pp. 1-8, (with Eng. transl.).

Rexroth Bosch Group, Re. 64 295/07.02: "LUDV Control Block of Mono and Sandwich Plate Design Type M7-22" Jul. 2002 (With English Translation).

Mannesmann Rexroth Re. 64 282/05.00: "High Pressure Load Sensing Control Block of Sanwich Plate Design Type M4-15" May 2000 (With English Translation).

"Variable Displacemenr Pump A10VO" Series 5, Open Circuits, SAE-Version, Axialpiston, Swash Plate Design. Re. 92703/04.96/ Mannesmann Rexroth. April 1996.

* cited by examiner

METHOD AND HYDRAULIC CONTROL SYSTEM FOR SUPPLYING PRESSURE MEDIUM TO AT LEAST ONE HYDRAULIC CONSUMER

CROSS-REFERENCE

The invention described and claimed hereinbelow is also described in PCT/EP2008/004990, filed on Jun. 20, 2008 and DE 10 2007 029 358.7, filed on Jun. 26, 2007. This German Patent Application, whose subject matter is incorporated here by reference, provides the basis for a claim of priority of invention under 35 U.S.C. 119 (a)-(d).

BACKGROUND OF THE INVENTION

The invention relates to a method for actuating a hydraulic consumer and a hydraulic control system for supplying pressure medium to the consumer.

U.S. Pat. No. 5,138,883 A has disclosed a hydraulic control system in which a consumer such as a differential cylinder can be supplied via a valve device—which is equipped with two continuously adjustable directional control valves—with pressure fluid that is furnished by a pump. The supply to the consumer and the return from it each contain a respective continuously adjustable directional control valve. In their neutral positions, the directional control valves are prestressed into a closed position and, by means of pressure reduction valves, can each be moved in one direction in which the pump is connected to the associated pressure chamber and in another direction in which the respective associated pressure chamber is connected to the tank. In this known control system, through suitable triggering of the two directional control valves, the consumer can be operated with a so-called regeneration circuit. For example, when a cylinder travels outward, the contracting annular chamber is connected via the associated directional control valve to the pressure fluid inlet of the expanding annular chamber so that the cylinder is extended in a rapid movement. A disadvantage of the regeneration/differential circuit, however, is that due to the restraining of the consumer (effective area corresponds approximately to the piston rod area), the consumer cannot be operated with the maximum output.

If a control system of this kind is used in a mobile piece of equipment such as a backhoe loader, a mini- or compact excavator, or a telehandler, then the available digging power in the regeneration mode is too low due to the restraining of the consumer. Preferably, the regeneration mode is correspondingly used when lowering the machine component of the mobile piece of equipment. In order to operate the consumer with a high power, for example when digging or when lifting a load, a switch into the normal mode is executed, in which the expanding pressure chamber is connected to the pump and the contracting pressure chamber is connected to the tank.

In order to prevent the occurrence of cavitation in the pressure fluid supply with a pulling load, a load lowering valve can be provided in the return from the consumer, as is known, for example, from DE 196 08 801 C2 or from the data sheet VPSO-SEC-42; 04.52.12-X-99-Z from the company Oil Control, a subsidiary of the applicant.

The directional control valves are moved by means of a piloting device, which is equipped with pressure reduction valves and is actuated by a joystick; the operator decides when to switch from regeneration mode into normal mode.

In this case, it is often difficult to determine the correct moment to make the switch, as a result of which the consumer remains too long in the regeneration mode with reduced power or the switch to the normal mode is made prematurely even though it would be advantageous to operate the consumer at a high speed.

By contrast, the object underlying the present invention is to optimize the switching from regeneration mode to normal mode with regard to the energy savings entailed by the regeneration mode and the power available at the consumer.

SUMMARY OF THE INVENTION

According to the invention, in order to actuate the consumer, a pressure chamber on the supply side and a pressure chamber on the return side of a hydraulic consumer are connected to a pump or a tank via a valve device that can be actuated by means of a control unit. To move the consumer rapidly, the valve device is moved into a regeneration mode in which the pressure fluid emerging from the return-side pressure chamber is added to the delivery rate of the pump so that the pump can be set to a lower delivery rate or the consumer executes its extending movement at a higher speed. The pressure fluid requirement is set by means of an actuator such as a joystick. According to the invention, the pump is set in accordance with a pressure regulation. In this case, a switch to the normal mode is automatically executed when the pump regulation reduces the pump delivery rate with no change in the set pressure fluid requirement (setting of the actuator), so that the consumer slows down or remains immobile. In other words, the pressure of the variable displacement pump is monitored. If it reaches its maximum pressure in the regeneration mode because of a rise in the resistance working against the consumer, then the swivel angle of the pump is reset in accordance with the characteristic curves of the pump control so that the volumetric flow of pressure fluid supplied by the pump no longer corresponds to the pressure fluid requirement preset for the actuator. According to the invention, a comparison of the pump flow rate to the pressure fluid requirement set by means of the actuator is used to decide when to switch to the normal mode. As a result, the optimum switching time is no longer decided based on the subjective assessment of the operator, thus permitting the consumer to be operated with greater operational reliability and improved effectiveness.

For example, the actual pump flow rate can be determined based on the swivel angle of the pump, which is embodied in the form of a variable displacement pump, and on the pump speed at a predetermined pump pressure.

The variable displacement pump is preferably embodied with an electroproportional swivel angle control; preferably, an actuating signal of a pressure control loop is then proportional to the swivel angle of the pump.

For this purpose, the actual pump pressure can be detected and compared to a setpoint pump pressure preset by means of the actuator. The pressure difference is then transmitted as an input signal to a controller, for example a PI controller or a PID controller, whose output signal is a measure for the swivel angle and constitutes the input signal of the pump controller.

The actuation of the consumer is further optimized if the regeneration mode is preset as a starting situation in certain movement directions of the consumer, for example when lowering an excavating component. In other words, as soon as the actuator (joystick) is moved in the lowering direction, a switch into the regeneration mode is automatically executed. This mode is maintained until the operator moves the joystick back into the zero position or beyond this zero position. The switch into the normal mode then occurs in the above-described fashion.

The switch between the regeneration mode and the normal mode preferably occurs by means of a ramp; the pressure fluid connection between the variable displacement pump and the expanding pressure chamber remains open and the pressure fluid connection of the contracting pressure chamber is opened in accordance with the curve of the ramp.

With a suitable embodiment, the swivel angle control of the variable displacement pump also permits a power control.

The apparatus complexity of the control system can be reduced if the supply and return of each consumer contains a continuously adjustable directional control valve, which has two switching positions, and a load lowering valve, thus permitting the supply and return to be actuated independently of each other.

The directional control valves, which are electrically or electrohydraulically adjustable, are preferably open to the tank in their neutral position.

The operational reliability of the control system is improved if the load lowering valves are embodied with a secondary pressure limiting function.

Other advantageous modifications of the invention are the subject of the remaining dependent claims.

BRIEF DESCRIPTION OF THE DRAWINGS

In the following, a preferred exemplary embodiment of the invention will be explained in greater detail in conjunction with schematic drawings.

DETAILED DESCRIPTION OF THE PREFERRED EMBODIMENTS

Figure 1:
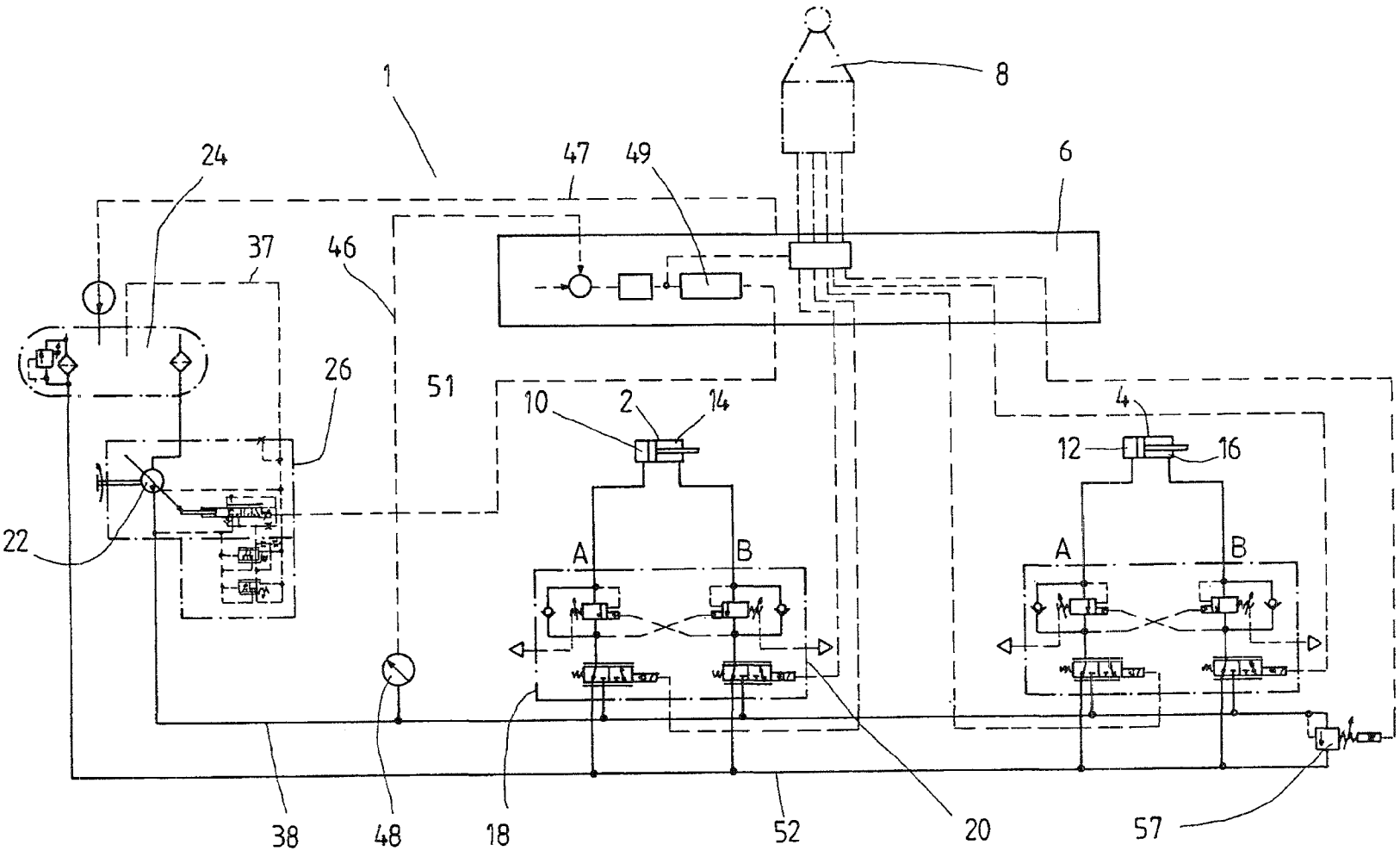
FIG. 1 is a schematic circuit diagram of a control system according to the invention for actuating two consumers.

FIG. 1 shows a hydraulic control system 1 for supplying pressure fluid to two consumers 2, 4 of a piece of mobile equipment such as an excavator, a backhoe loader, a mini- or compact excavator, or a telehandler. It is a so-called EFM system (electronic flow management) in which the valve elements that determine the volumetric flow of pressure fluid and the flow direction of the pressure fluid are electrically or electrohydraulically triggered as a function of characteristic curve families stored in a control unit 6. In this case, the setpoint values are input by means of a joystick 8 that is actuated by the operator in order to control the speed and position of the machine components (e.g. booms, shovels) of the piece of equipment.

In the exemplary embodiment shown, the two consumers 2, 4 are each embodied in the form of a differential cylinder with a pressure chamber 10 or 12 at the bottom and an annular chamber 14 or 16 around the piston rod. These pressure chambers 10, 14; 12, 16 can be respectively connected via a directional control valve section 18, 20 to a variable displacement pump 22 or a tank 24 in order to retract or extend the cylinder. The variable displacement pump 22 is pressure-controlled by means of a pump controller 26, which, once the predetermined pressure has been reached, adjusts the delivery rate of the pump so that the pressure in the system remains constant independent of the delivery rate. A change in the volumetric flow of the pressure fluid should result in practically no change in pressure.

The variable displacement pump 22 is moved by means of a pump controller 25, whose design is explained below in conjunction with the enlarged depiction in FIG. 2. By means of an electroproportional swivel angle control, the pump controller 25 permits an infinitely variable and reproducible adjustment of the displacement volume of the variable displacement pump, directly controlled by means of a swiveling swashplate of the pump. Pump controllers of this kind are known, for example, from the data sheet RD 92 708—in particular, see the variants EP and EK, so that only those features of the pump controller 25 required for comprehension of the invention are described in the present application.

A pump controller 25 of this kind has a pump control valve 26 that is embodied with three connections and is prestressed by a control spring 27 in the direction of a neutral position in which the three connections of the pump control valve 26 are closed. The control spring 27 is supported against the actuating piston 28 of an actuating cylinder 29 by means of which it is possible to swivel the swiveling swashplate of the variable displacement pump 22. The actuating piston 28 is prestressed by a spring into a home position in which the swivel angle of the variable displacement pump 22 is at a maximum. The valve slider of the pump control valve 26 is actuated by means of a proportional magnet 30 that can be supplied with current via a signal line 51 connected to the control unit 6.

This proportional magnet 30 is used to exert the control force on the control piston of the pump control valve 26; the movement occurs in proportion to the power of the current. An input connection of the pump control valve 26 is connected via a control line 31 to a pump line 38 connected to the pressure connection of the variable displacement pump 22. An output connection of the pump control valve 26 is connected via a conduit 32 to a control surface of the control piston that acts in the direction of the neutral position. This control surface delimits a spring chamber of the control spring 27. The pressure in the conduit 32 also impinges on a control surface that acts in the movement direction of the pump control valve 26 so that the pressure at the outlet of the pump control valve impinges on both sides of the control piston.

The conduit 32 is connected via a nozzle 33 to a connecting conduit 34 that contains two pressure limiting valves 35, 36 connected in series. The outlet of the downstream pressure limiting valve 36 in FIG. 2 is connected to the tank 24 via a tank control conduit 37.

The two pressure limiting valves 35, 36 are prestressed in the direction of their depicted home position in which the pressure fluid connection to the tank control conduit 37 is open.

The pressure in the control line 31, which is tapped via a pressure limiting line 39, acts on both of the pressure limiting valves 35, 36 in the switching direction. This pressure limiting line 39 also leads to the respective third connection of both pressure limiting valves 35, 36. The region of the connecting conduit 34 situated between the pressure limiting valve 35 and the nozzle 33 is connected to the spring chamber of the control spring 27 via a branch line 40 and a check valve that opens in the direction toward the pressure limiting valve 35. A connecting line also branches off from the pressure fluid flow path between the nozzle 33 and the pressure limiting valve 35 and is connected to the tank control conduit 37 via two additional nozzles 41, 42. An angle conduit 43 branches off between the two nozzles 41, 42 and feeds into the pressure fluid flow path between the two pressure balances 35, 36. Control surfaces that act in the direction of the spring-prestressed home position of the pressure limiting valves 35, 36 are also connected to the tank control conduit 37 via pilot lines 44, 45.

The two pressure limiting valves 35, 36 are set to different pressures. When the respective pressure is reached, the relevant pressure limiting valve 35, 36 is moved out of its depicted home position, thus opening a control oil flow path from the pump line 38 to the spring chamber of the control spring via the control line 31, the pressure limiting line 39, the relevant pressure limiting valve 35, 36, the connecting conduit 34, and the branch line 40 so that a pressure approximately equivalent to the pump pressure prevails in this spring chamber. Consequently, the actuating piston 28 is then moved toward the left in the depiction according to FIG. 2 in opposition to the force of the return spring and the swivel angle is reset to zero so that the volumetric displacement is correspondingly minimal or equal to zero.

In the normal mode of the variable displacement pump, the two pressure limiting valves 35, 36 are prestressed into their depicted home position. Adjusting the swivel angle of the pump requires a predetermined standby pressure of 20 bar, for example; only then is it possible to overcome the force of the return spring.

In the depicted home position—as mentioned above—the swivel angle of the variable displacement pump 22 is set to its maximum value. When the proportional magnet 30 is supplied with current, the control piston of the pump control valve 26 in the depiction according to FIG. 2 is moved to the left so that the control line 31 is connected to the conduit 32 and a pressure corresponding to the pump pressure prevails in the spring chamber of the control spring 27. This pressure then moves the return piston 28 in opposition to the force of its return spring in the direction toward a minimization of the swivel angle so that the pump delivery rate approaches zero. As the pump control valve 26 is moved farther toward the left, the pressure fluid connection between the control line 31 and the conduit 32 is closed and the spring chamber of the control spring 27 is connected via the branch line 40 to the connecting conduit 34 and therefore to the tank control conduit 37 so that the control oil can flow out of the spring chamber into the tank 24 and the force of the return spring correspondingly moves the actuating piston 28 in the direction of an increase of the swivel angle. Correspondingly, the pump delivery rate increases in proportion to the power of the current in the proportional magnet 30. In the event of the cable break or a loss of the control signal, the depicted variable displacement pump 22 swivels back into its home position in which the maximum swivel angle is set.

For further details relating to the design of the pump controller 26, the reader is referred to the above-mentioned data sheet RD 92 708.

As can also be inferred from the depiction in FIG. 1, the pressure in the pump line 38 is detected by a pressure sensor 48 and reported to the control unit 6 via a signal line 46. This pressure signal corresponding to the actual pump pressure is compared to the setpoint pressure preset by means of the joystick 8 and the output signal is sent to an electronic PI controller or PID controller 47. By means of software in the control unit 6, the output signal of this controller is then taken into account in the triggering of the directional control valve sections 18, 20. The output signal is also transmitted to the proportional magnet 30 via a signal amplifier 49 and a signal line 51 in order to move the control piston of the pump control valve 26; in the control position of the control piston, an equilibrium is reached between the force exerted by the proportional magnet 30 and the force exerted on the control piston in the opposite direction by the control spring 27 and the actuating piston 28.

The suction connection of the variable displacement pump 22 is connected to the tank 24 via a suction line 50 and a filter. The pressure fluid supplied by the variable displacement pump 22 flows to the consumers 2, 4 via the pump line 38 and the two directional control valve sections 18, 20, whose design is explained below in conjunction with FIG. 2. On the return side, the pressure fluid flows from the consumers 2, 4 to the tank 24 via the associated directional control valve sections 18, 20 and a tank line 52; in the end section of the tank line 52, an additional filter is provided, which can be bypassed via a pressure limiting valve that opens when the filter becomes clogged and the pressure loss induced by the filter rises as a result.

The temperature of the pressure fluid contained in the tank 24 is detected by a temperature sensor 54 and reported to the control unit 6 via a signal line. In order to prevent an overheating of the pressure fluid, a purge valve 57 is provided between the tank line 52 and the pump line 38. This purge valve 57 also has a pressure limiting function that makes it possible to limit the pressure in the pump line 38 to a maximum pressure. When the purge valve 57 is opened, the pressure fluid used to actuate the consumer, particularly in the regeneration circuit, can be exchanged for "fresh" pressure fluid from the tank 24. The opening of the purge valve 57 is likewise executed electrically as a function of a signal from the control unit 6.

Figure 3:
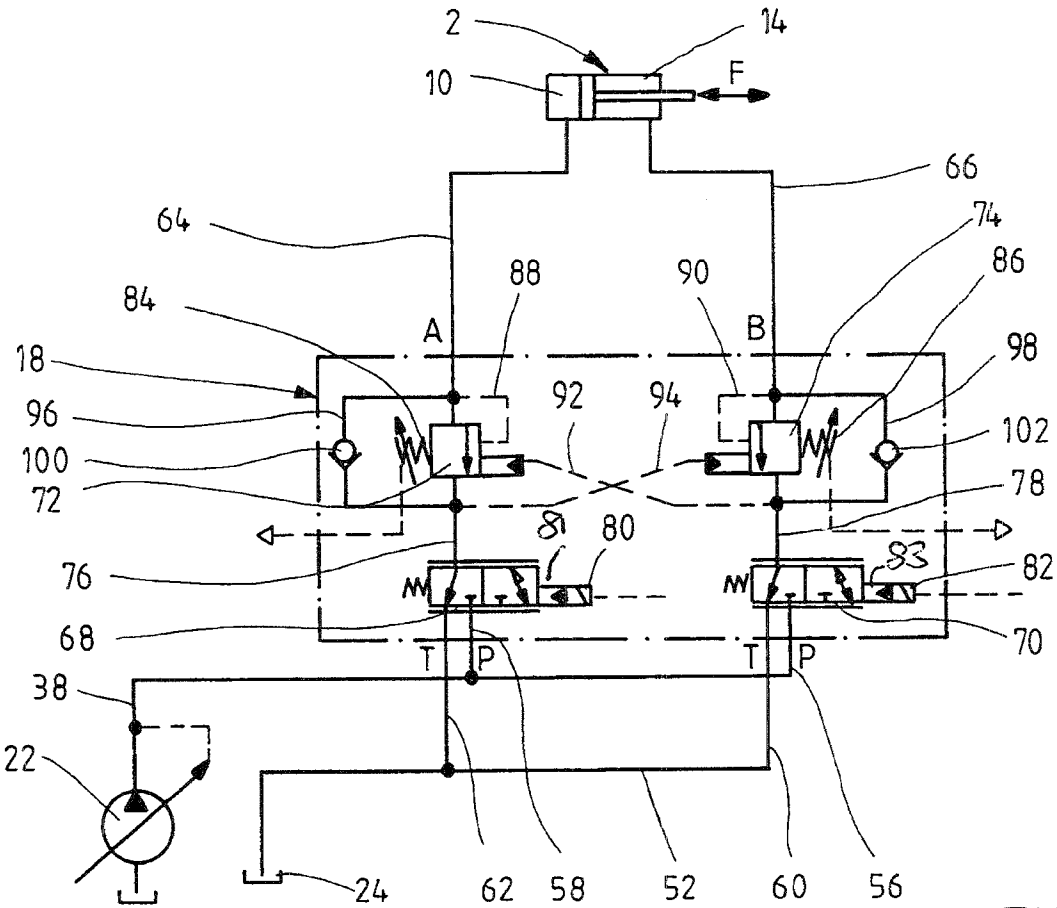
FIG. 3 is a partial depiction of a directional control valve section of the control system from FIG. 1, FIGS. 4 through 6 show different load situations in the regeneration mode or in the normal mode of the control system

FIG. 3 shows the basic design of the two directional control valve sections 18, 20; the directional control valve segment 18 is shown by way of example and the variable displacement pump 22 and tank 24 are schematically depicted.

According to FIG. 3, the directional control valve section 18 has two pressure connections P that are each connected to the pump line 38 via a respective inlet line 56, 58. Two tank connections T of the directional control valve section 18 are connected to the tank line 52 via outlet lines 60, 62. Each connection pair P, T of the directional control valve section 18 is associated with a respective working connection A or B, each of which is connected via a respective supply line 64 or return line 66 to the pressure chamber 10 or annular chamber 14 of the consumer 2. The pressure fluid flow paths between the connections P, T and the associated working connections A, B each contain a respective continuously adjustable 3-port directional control valve 68, 70, which has two switching positions and three connections, and a respective load lowering valve 72, 74. Each directional control valve 68, 70 is prestressed by a control spring into its depicted neutral position in which a pressure fluid connection is open between the outlet line 60, 62 and a connecting conduit 76, 78 that respectively extends to the adjacent load lowering valve 72, 74.

Each directional control valve 68, 70 is adjusted by means of a respective pilot valve 81, 83 with a proportional magnet 80, 82 that can be supplied with current by the central control unit 6 via signal lines in order, by adjusting the pilot valves 81, 83, for example of pressure reduction valves, to move the directional control valve 68, 70 independently of each other in the direction of their position shown in FIG. 3 in which the pressure fluid connections are opened between the inlet lines 56, 58 and the connecting conduits 78, 76. Consequently, the two directional control valves 68, 70, with their neutral position that is open in relation to the tank 24, have an extremely simple design in which by contrast with the prior art described at the beginning, only one pilot valve and one proportional magnet 80, 82 are required to execute the movement, whereas in the known embodiments with a closed neutral position, it is necessary to use two expensive proportional magnets. In principle, the directional control valves 68, 70 can also be triggered directly by means of the proportional magnets.

The two load lowering valves 72, 74 have an intrinsically known design of the kind described, for example, in DE 196 08 801 C2, which was mentioned at the beginning, or in the above-mentioned publication from the company Oil Control. Load lowering valves of this kind permit the controlled lowering of a load and simultaneously function as a secondary pressure limiting valve. To that end, the load lowering valves are prestressed into a closed position by means of an adjustable prestressing spring 84, 86. As shown in FIG. 2, the spring chambers of the two prestressing springs 84, 86 are vented toward the atmosphere. The respective pressure at the associated working connection A, B, which is tapped by means of a respective pressure limiting control line 88, 90, acts in the opening direction. The pressure in the respective other connecting conduit 76, 78, the so-called "cross-over", which is tapped by means of opening lines 92, 94, also acts in the opening direction. Furthermore, the two load lowering valves 72, 74 can also provide leakage-free support to the load acting on the consumer 2. The supply of pressure fluid from the directional control valve 68, 70 to the respective pressure chamber of the consumer 2 takes place via a respective bypass conduit 96, 98 that connects the connecting conduit 76, 78 to the respective supply line 64, 66; each bypass conduit 96, 98 contains a check valve 100, 102 that opens in the direction toward the consumer 2.

In the neutral positions—depicted in FIGS. 1 and 3—of the two directional control valves 68, 70, the two pressure chambers of each consumer 2, 4 are connected to the tank 24. The load F acting on the consumer 2 is supported in a leakage-free fashion by the load lowering valve 72, 74, which is embodied in the form of a seat valve. In this case, the load F can be in the form of a pulling or pushing load. The pressure limiting function of the two load lowering valves 72, 74 ensures that a maximum pressure cannot be exceeded in the lines 64, 66.

Several load situations will be explained below to better illustrate the invention.

Figure 4:
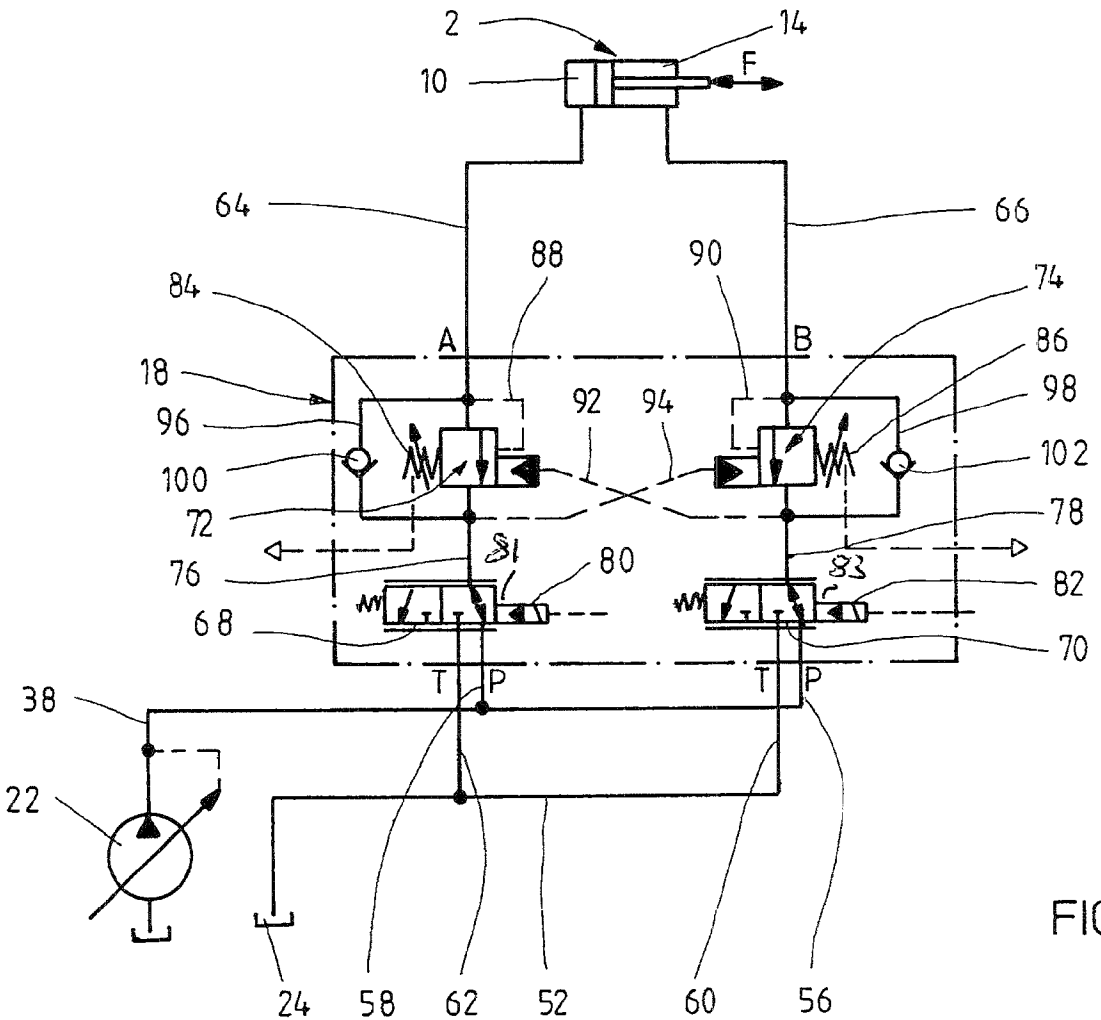

Let us first assume that a pulling load F is acting on the cylinder 2 and that according to the depiction in FIG. 4, the cylinder is to be extended (movement toward the right). This extending motion should occur at a maximum speed (rapid movement). For this purpose, the two directional control valves 68, 70 are moved in the direction toward the position shown in FIG. 4 in which a regeneration occurs. In other words, the consumer 2 is triggered by means of a differential circuit in which both the annular chamber 14 and the bottom pressure chamber 10 are connected to the pump 22. To accomplish this, the two proportional magnets 80, 82 move the directional control valves from the neutral position (FIG. 3) toward the left so that both pressure connections P of the directional control valve section 18 are connected to the connecting conduits 76, 78. The pump 22 supplies the pressure fluid into the expanding bottom pressure chamber 10 via the pressure connection P, the directional control valve 68, the connecting line 76, the bypass conduit 96, the check valve 100, and the supply line 64. The pressure fluid displaced from the annular chamber 14 flows via the return line 66, the load lowering valve 74 that the pressure in the connecting conduit 76 has completely opened in the pressure limiting function, the connecting conduit 78, and the directional control valve 70, to the inlet line 56 and from there, into the pump line 38 so that the volumetric flow of pressure fluid emerging from the consumer is added to the volumetric flow of pressure fluid delivered by the pump 22.

In the bottom pressure chamber 10, a pressure is present, which after the slider is set, lies between the maximum pump pressure (for example 250 bar) and 0 bar (slider in the neutral position). If one assumes that the pressure in the annular chamber 14 is approximately 250 bar (slider of the directional control valve 70 completely open, pump set to 250 bar) and that the pulling load corresponds to a pressure of 50 bar, then the bottom pressure chamber 10 must contain a pressure that equals the difference of the pressure in the annular chamber 14 minus the load, divided by the area ratio of the differential cylinder (for example 2) so that 250 bar in the annular chamber 14 and a load of 50 bar results in a pressure of approximately 100 bar in the pressure chamber 10.

With a pushing load, an equivalent function occurs in which the pressure in the supply-side supply line 64 is limited by the pressure limiting function of the load lowering valve 72.

Figure 5:
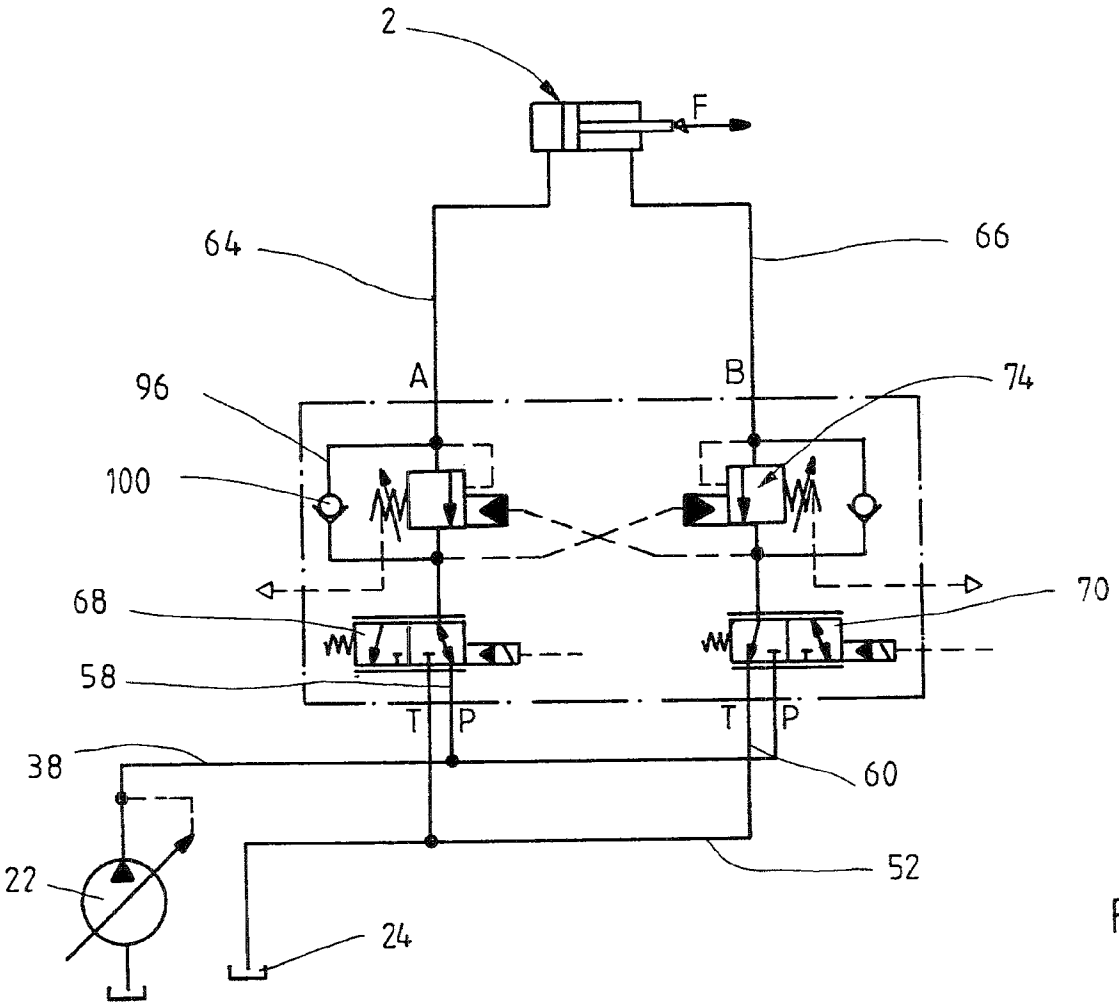

In regeneration mode, the consumer is moved at maximum speed; the force exerted by the consumer, however, is comparatively slight because the effective area of the consumer corresponds to the piston rod area. In order to trigger the maximum output of the consumer 2, the control system is switched from regeneration mode to the normal operating mode shown in FIG. 5 by moving the directional control valve 70 in the direction of its neutral position so that the pressure fluid flows out of the annular chamber 14 to the tank 24 via the return line 66, the open load lowering valve 74, the connecting conduit 78, and via the directional control valve 70 and the outlet line 60. With a pulling load (FIG. 5), cavitations in the vicinity of the supply line 64 are reliably prevented by means of the load lowering valve 74 since this valve, by restraining the consumer 2, prevents an uncontrolled, excessively rapid extending motion of the consumer 2 as a result of the pulling load. In this case, the maximum pressure in the return line 66 is limited by the secondary pressure limiting function of the load lowering valve 74. The pressure in the pressure fluid supply is in turn determined by means of the opening cross section established by the slider of the directional control valve 68 and consequently lies between 0 bar and the maximum pump pressure (for example 250 bar).

With a pushing load and an extending cylinder 2 (FIG. 5), depending upon the slider position of the directional control valve 68 and the triggering of the variable displacement pump 22, a pressure occurs in the bottom pressure chamber 10 that lies between the load pressure and the maximum pump pressure (consumer against stop). The load lowering valve 74 situated in the return is opened completely by the pressure in the inlet (tapped via the opening line 94) so that the pressure fluid can flow out of the annular chamber 14 and into the tank 24. In this load situation, no regeneration mode is provided and there is no danger of cavitations.

Figure 6:
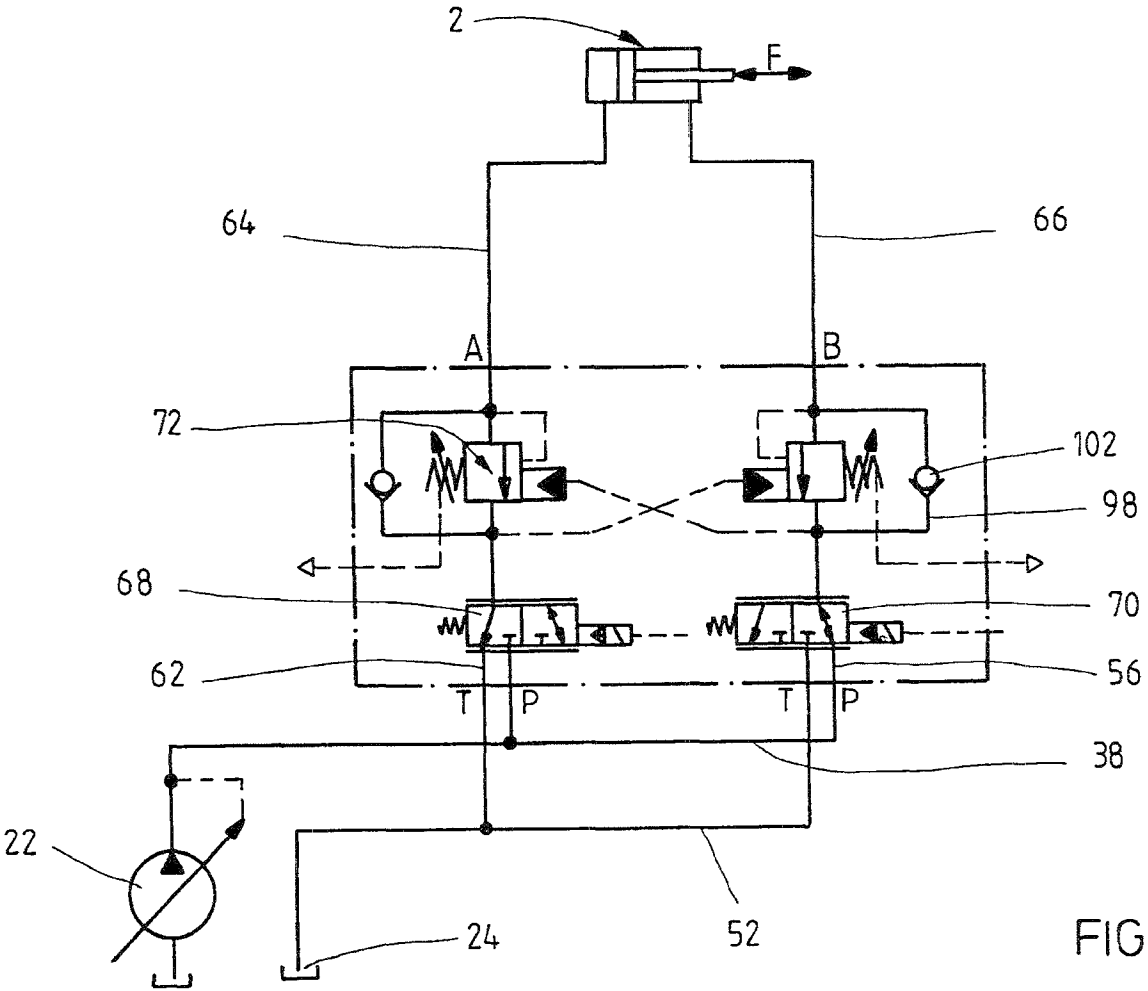

With a retracting cylinder and a pulling or pushing load, the directional control valve section 18 is switched into the position shown in FIG. 6 in which the directional control valve 68 opens the pressure fluid connection to the tank 24 and the pump 22 conveys pressure fluid into the annular chamber 14 via the directional control valve 70. The pressure in the inlet to the annular chamber 14 then depends on the load, the opening cross section of the directional control valve 70, and the set pump pressure. The pressure fluid is conveyed via the bypass conduit 98 and the opening check valve 102 and via the return line 66 into the annular chamber 14 and flows out of the contracting pressure chamber 10 and into the tank 24 via the supply line 64, the load lowering valve 72 that has been opened by the pressure in the inlet (connecting conduit 78), the directional control valve 68 that has been moved in the direction of its neutral position, and the outlet line 62. In this case, the load lowering valve 72 limits the pressure level in the outlet. Depending on the load direction, the pressure level in the inlet lies between the maximum pump pressure and 0 bar (pushing load, minimum retraction speed).

According to the invention, it is preferable if the regeneration mode is activated by default in a certain movement direction of the consumer 2, 4. This can be the case, for example, when lowering the machine component of an excavator, for example a boom with a shovel. If the resistance to the movement of the working equipment subsequently rises, then the pump pressure of the variable displacement pump 22 is increased and is limited to a maximum value by the pump controller. As described at the beginning, when this maximum value is reached, the swivel angle of the variable displacement pump 22—and therefore also the actuating signal for the swivel angle—is limited so that the volumetric flow of pressure fluid supplied by the pump no longer corresponds to the pressure fluid requirement preset by means of the joystick 8. According to the invention, the relevant directional control valve section 18, 20 is switched into the above-described normal mode without intervention by the operator so that the maximum digging power is available, for example. The variable displacement pump 22 can be embodied with a swivel angle sensor for determining the swivel angle.

Figure 2:
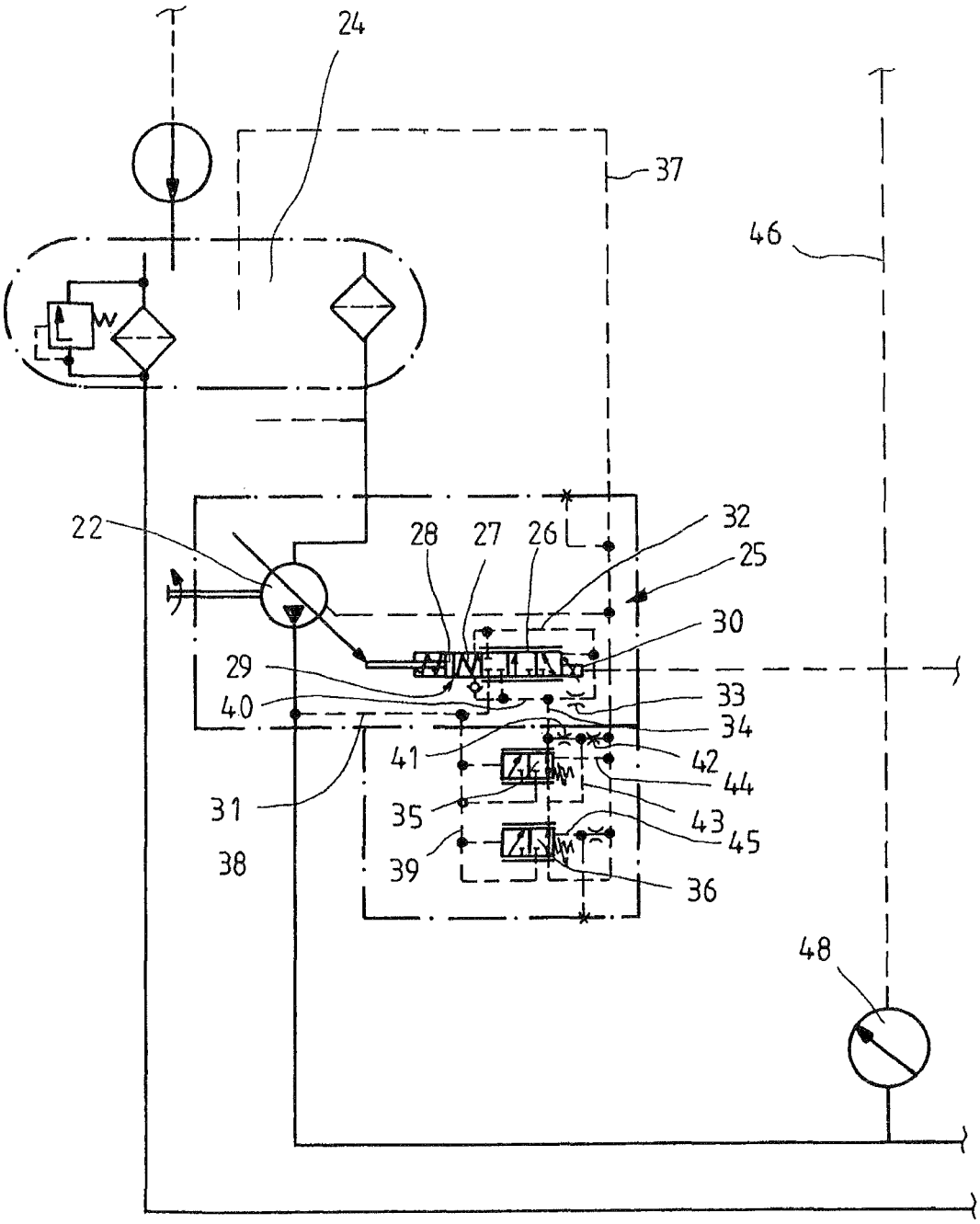
FIG. 2 is an enlarged depiction of a variable displacement pump of the control system from FIG. 1.
Figure 7:
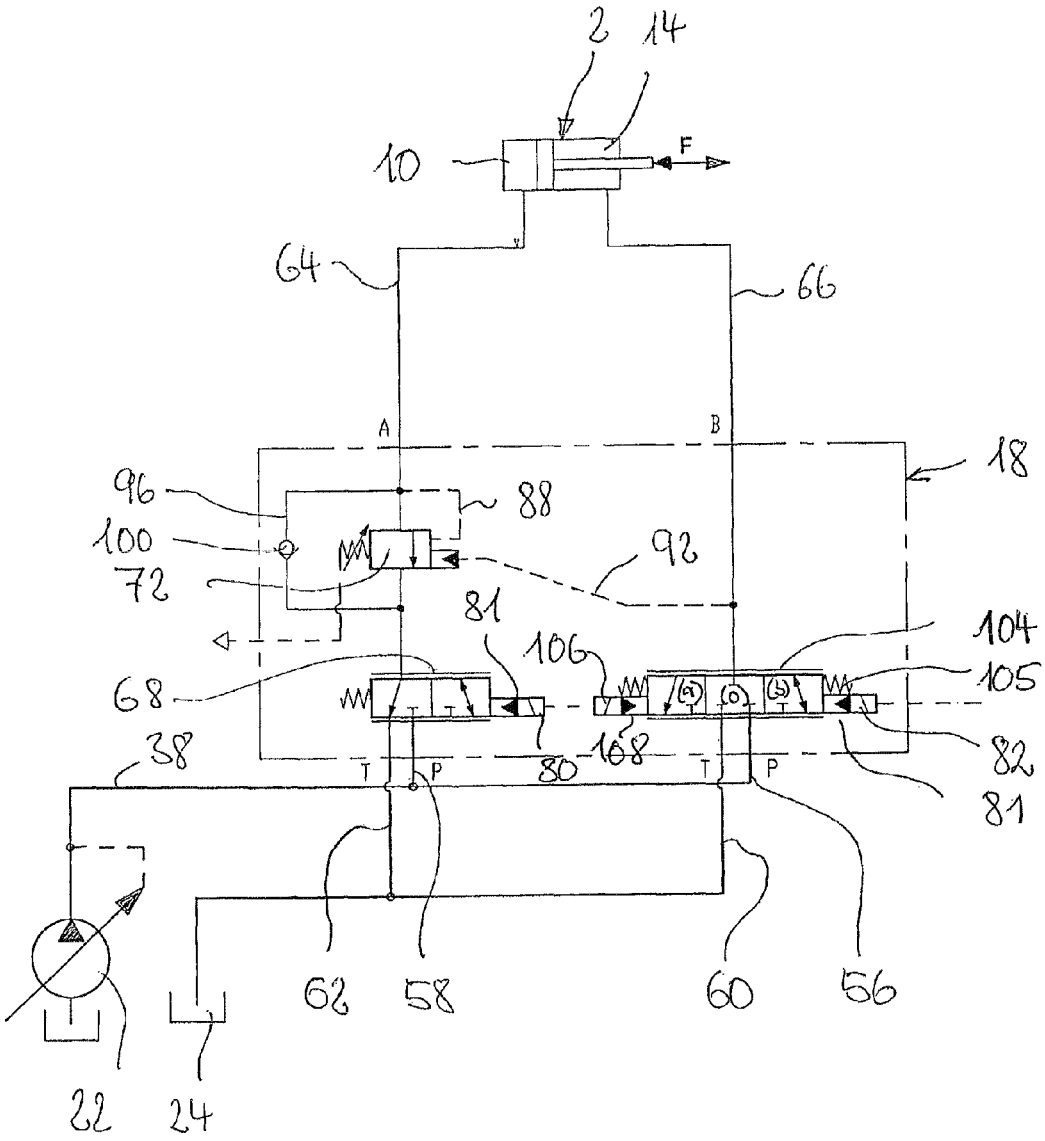
FIG. 7 is a simplified embodiment of the directional control valve section from FIG. 3.

FIG. 7 shows a simplified exemplary embodiment of the control system 1 according to FIG. 2. The sole difference between it and the above-described exemplary embodiment according to FIG. 2 lies in the fact that the line that is connected to the consumer 2 and is referred to as the return line 66 contains neither a load lowering valve nor an associated directional control valve equipped with two so-called "switching positions," but is instead provided with a single continuously adjustable directional control valve 104, which is prestressed into a home position (0) by a centering spring arrangement 105 and can be moved in the direction of the positions (a) and (b) shown in FIG. 7 through actuation of two pilot valves 108, 83. The two pilot valves 83, 108—as in the above-described exemplary embodiment—are embodied as pressure reduction valves that can each be triggered by means of a respective proportional magnet 82, 106. The design of the valves embodied in the supply line 64—with the load lowering valve 72, the check valve 100, and the directional control valve 68 prestressed into an open position, which can only be moved in one direction by means of a single pilot valve 81—and the pressure fluid supply correspond to those of the above-described exemplary embodiment, rendering explanations of them unnecessary. For the sake of simplicity, the hydraulic components that correspond to one another have been provided with the same reference numerals as in the exemplary embodiment described at the beginning and the reader is referred to the description given with regard to them.

In the depicted home position (0) of the continuously adjustable directional control valve 104, the pressure fluid connection between the outlet line 60, the inlet line 56, and the return line 66 is closed. When the proportional magnet 106 is supplied with current, the pressure reducing valve 108 can be used to set a control pressure so that the valve slider of the directional control valve 104 is moved toward the right in the direction of the position labeled (a) in which the connection between the return line 66 and the outlet line 60 is opened. The pressure fluid connection to the inlet line 56 remains closed. When the pilot valve 83 is triggered, the valve slider of the directional control valve 104 is moved in the direction of position (b) so that the pressure fluid connection between the inlet line 56 and the return line 66, which is then functioning as a supply line, is correspondingly opened; the pressure fluid connection between the return line 66 and the outlet line 60 is closed.

The actuation of the load lowering valve 72 situated in the supply line 64 is carried out—as in the exemplary embodiment described at the beginning—by means of the pressure in the return line 66.

Naturally, the directional control valve 104 can also be integrated into the supply line 64 so that the load lowering valve 74 and the directional control valve 70 from FIG. 3 remain situated in the return line 66.

In order to retract the hydraulic cylinder (consumer 2), the directional control valve 104 is moved in the direction of its position of its positions (b) (sic) so that the variable displacement pump 22 conveys pressure fluid to the annular chamber 14 of the consumer via the pump line 38, the inlet line 56, the directional control valve 104, and the return line 66, which is then functioning as an inlet line. The directional control valve 104 is then used to correspondingly set the volumetric flow of pressure fluid and also the effective pressure in the annular chamber 14. The pressure in the return line 66 is used to move the load lowering valve 72 into its open position so that for example with a pushing load, cavitations are prevented since the consumer 2 remains restrained. With a pulling load, the load lowering valve 72 is completely or almost completely opened by the pressure in the supply, which pressure is tapped via the opening line 92, thus allowing the pressure fluid to flow out into the tank 24 via the load lowering valve 72 and the correspondingly set directional control valve 68.

During the extending movement of the consumer (hydraulic cylinder 2), the control system can also be operated once again in the regeneration mode; then the pilot valve 81 is used to switch the directional control valve 68 and the pilot valve 83 is used to move the directional control valve 104 toward its position (b) so that the pressure fluid flows out of the annular chamber 14 via the directional control valve 104, into the inlet line 58 and from there, via the directional control valve 68 and the check valve 100, the bypass conduit 96, and the supply line 64 to the pressure chamber 10 so that the consumer 2 is extended at a high speed. To exert a greater force, the directional control valve 104 is moved toward its position (a) so that the pressure fluid flows out of the annular chamber 14 into the tank 24. For further details about the various operating modes, please refer to the preceding explanations.

The present application has disclosed a hydraulic control system and a method for triggering a hydraulic consumer, which has a pressure chamber on the supply side and a pressure chamber on the return side that are connectable to a pump or a tank via a valve device. The valve device is actuated by means of a control unit that can move the valve device into a regeneration mode in which both of the pressure chambers are connected to the pump. According to the invention, the pump is pressure-regulated; in the regeneration mode, a switch to a normal mode—in which the inlet-side pressure chamber is connected to the pump and the return-side pressure chamber is connected to the tank—is automatically executed when the pump delivery rate falls below the pressure fluid requirement.

What is claimed is:

1. A method for triggering a hydraulic consumer (2, 4), which has a supply side pressure chamber (10, 14) and a return side pressure chamber (12; 16), wherein a connection of the pressure chambers to a pump (22) or a tank (24) is switchable by means of a valve device (18, 20) controlled by a control unit (6), wherein via a connection of the pressure chambers (10, 14; 12, 16) with the pump (22), the supply pressure chamber (10, 12; 14, 16) and the return side pressure chamber (14, 16; 10, 12) are connected with one another, characterized by the steps:

connecting the supply side pressure chamber (10, 12; 14, 16) with the return side pressure chamber (14, 16; 10, 12) by a switching of the valve device (18, 20) via a control unit (6) in order to supply pressure fluid supplied by the return side pressure chamber and pressure fluid supplied by the pump (22) together to the supply side pressure chamber (10, 12; 14, 16) in a regeneration mode;

providing a setpoint pump pressure of the pump (22);

detecting the actual pressure of the pump (22);

comparing the actual pump pressure with the setpoint pump pressure in order to connect the supply side pressure chamber (10, 12; 14, 16) with the pump (22) and the return side pressure chamber (14, 16; 10, 12) with the tank (24) via a switching of (18, 20) by means of the control unit (6) when the actual pump pressure is lower than the setpoint pump pressure, during a normal mode.

2. The method as recited in claim 1, wherein the pump delivery rate is calculated from the swivel angle and the pump speed at a given pump pressure.

3. The method as recited in claim 1, wherein the actual pump pressure is detected and compared to a preset setpoint pump pressure and the pressure difference is transmitted as an input signal to a controller (47) whose output signal is a measure for the swivel angle.

4. The method as recited in claim 1, wherein the pump is a variable displacement pump (22) associated with an electro-proportional swivel angle control.

5. The control system as recited in claim 4, further comprising a swivel angle sensor for detecting a swivel angle of the adjusting pump (22).

6. The control system as recited in claim 4, wherein the power of the adjusting pump (22) is controlled by the swivel angle control.

7. The method as recited in claim 1, wherein the regeneration mode is preset as a starting situation in a certain movement direction of the consumer (2, 4).

8. The method as recited in claim 1, wherein the switch from the regeneration mode to the normal mode occurs in a ramp-shaped way.

9. The method as recited in claim 1, wherein the supply of the pressure fluid is lowered by maintaining the actual pump pressure when the actual pump pressure achieves a predetermined value.

10. A control system for controlling a hydraulic consumer (2, 4), comprising:

a supply side pressure chamber (10, 12; 14, 16) and a return side pressure chamber (14, 16; 10, 12), wherein said supply side chamber (10, 12; 14, 16) and said return side pressure chamber (14, 16; 10, 12) are connected with a pump (22) or a tank (24) by an electrical or electro-hydraulic continuously adjustable valve device (18, 20), wherein via a connection of the pressure chambers (10, 14; 12, 16) with the pump (22), the supply side pressure chamber (10, 12; 14, 16) and the return side pressure chamber (14, 16; 20, 12) are connected to one another;

an adjusting element for setting a setpoint pump pressure of the pump (22);

a pressure sensor (48) for detecting the actual pump pressure of the pump (22); and a control unit (6), wherein the valve device (18, 20) is controlled by the control unit (6), such that the valve device (18, 20) is switchable between a regeneration mode and a normal operation mode, wherein in the regeneration mode, the supply side pressure chamber (10, 12; 14, 16) is connected with the return pressure chamber (14, 16; 10, 12), whereby the pressure fluid supplied by the return side pressure chamber (14, 16; 10, 12) and the pressure fluid supplied by the pump (22) are supplied together to the supply side pressure chamber (10, 12; 14, 16), and wherein in a normal operating mode, the actual pump pressure is compared with the setpoint pump pressure, wherein when the actual pump pressure is lower than the setpoint pump pressure the supply side pressure chamber (10, 12; 14, 16) is connected with the pump (22) and the return side pressure chamber (14, 16; 10, 12) is connected with the tank (24).

11. The control system as recited in claim 10, wherein the pump (22) is a variable displacement pump (22) equipped with an electroproportional swivel angle control.

12. The control system as recited in claim 10, wherein a controller (47) for generating an input signal for a pump controller (25) as a function of the comparison of the actual pump pressure to the setpoint pump pressure is provided on the control unit (6).

13. The control system as recited in claim 12, wherein the controller (47) is a PI controller or a PID controller.

14. The control system as recited in claim 10, wherein the supply (64) and return (66) of each consumer (2, 4) contains an electric or electrohydraulic continuously adjustable directional control valve (68, 70), which has two switching positions, in which a connection of the supply (64) and the return (66) with the sumo (22) or with the tank (24) is made possible, and a load lowering valve (72, 74), wherein one of the switching positions of the direction control valves (68, 70) is an open neutral position, in which a connection of the supply (64) and the return (66) with the tank (24) is created.

15. The control system as recited in claim 14, wherein the load lowering valve (72, 74) has a pressure limiting function.

16. The control system as recited in claim 10, wherein a pump controller (25) is provided on the pump (22), wherein the pump (22) is adjusted via the pump controller (25) by means of the pump supply flow by maintaining the actual pump pressure (22).

17. The control system as recited in claim 10, wherein the control unit (6) adjusts the pump controller (25), such that a pressure fluid flow is lowered by the pump controller (25) when the actual pump pressure detected by the pressure sensor (48) achieves a predetermined value.

* * * * *